US009835174B2

(12) United States Patent
Dietrich et al.

(10) Patent No.: US 9,835,174 B2
(45) Date of Patent: Dec. 5, 2017

(54) ANTI-ROTATION LUG AND SPLITLINE JUMPER

(71) Applicant: ANSALDO ENERGIA IP UK LIMITED, London (GB)

(72) Inventors: Douglas James Dietrich, West Palm Beach, FL (US); Kevin Damian Carpenter, Palm Beach Gardens, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 756 days.

(21) Appl. No.: 14/184,780

(22) Filed: Feb. 20, 2014

(65) Prior Publication Data

US 2014/0271146 A1 Sep. 18, 2014

Related U.S. Application Data

(60) Provisional application No. 61/793,960, filed on Mar. 15, 2013.

(51) Int. Cl.

| | |
|---|---|
| ***F04D 29/64*** | (2006.01) |
| ***F04D 29/08*** | (2006.01) |
| ***F01D 5/32*** | (2006.01) |
| ***F04D 29/54*** | (2006.01) |
| *F01D 5/30* | (2006.01) |

(52) U.S. Cl.

CPC ..... *F04D 29/644* (2013.01); *F01D 5/32* (2013.01); *F04D 29/083* (2013.01); *F04D 29/542* (2013.01); *F01D 5/3046* (2013.01); *Y10T 29/49236* (2015.01)

(58) Field of Classification Search

CPC .... F04D 29/644; F04D 29/542; F04D 29/083; F01D 5/32; F01D 5/3046

See application file for complete search history.

(56) References Cited

U.S. PATENT DOCUMENTS

| | | | | |
|---|---|---|---|---|
| 5,022,818 A * | 6/1991 | Scalzo | F04D 29/542 415/189 |
| 2005/0214116 A1* | 9/2005 | Proveaux | F01D 25/246 415/209.2 |
| 2010/0129211 A1* | 5/2010 | Hart | F01D 9/042 415/209.3 |
| 2013/0084163 A1* | 4/2013 | Wiebe | F16D 66/02 415/118 |

* cited by examiner

*Primary Examiner* — Moshe Wilensky

(74) *Attorney, Agent, or Firm* — Hovey Williams LLP; Peter Knops

(57) ABSTRACT

The present invention relates to a system and method for joining adjacent sections of a compressor diaphragm. A splitline jumper is positioned within a recessed portion of a seal ring segment of the adjacent compressor diaphragms. The splitline jumper is sized and oriented so as to prevent axial movement of the compressor diaphragms relative to each other and also to prevent rotational movement of the seal ring relative to the diaphragm.

5 Claims, 3 Drawing Sheets

ANTI-ROTATION LUG AND SPLITLINE JUMPER

CROSS-REFERENCE TO RELATED APPLICATIONS

This application claims priority to U.S. Provisional Patent Application Ser. No. 61/793,960 filed on Mar. 15, 2013 and entitled the same as the present patent application.

TECHNICAL FIELD

The present invention generally relates to methods and systems concerning a connecting component for use in a compressor that also provides anti-rotation capabilities.

BACKGROUND OF THE INVENTION

Gas turbine engines operate to produce mechanical work or thrust. More specifically, land-based gas turbine engines typically have a generator coupled thereto for the purposes of generating electricity through the mechanical work produced by the gas turbine engine. A gas turbine engine comprises an inlet that directs air to a compressor section, which has stages of rotating compressor blades. As the air passes through the subsequent stages of the compressor, the pressure of the air increases. The compressed air is then directed into one or more combustors where fuel is injected into the compressed air and the mixture is ignited to form hot combustion gases. The hot combustion gases are then directed from the combustion section to a turbine section. As the hot combustion gases pass through the stages of the turbine, the heated gas causes the stages of turbine blades to rotate, which in turn, causes the compressor to rotate.

The air from the inlet is directed through a compressor section, with the compressor having a plurality of alternating axial stages of rotating blades and stationary vanes. As the air travels through the compressor, its pressure increases as well as its temperature. An axial stage of compressor vanes and mounting hardware forms a compressor diaphragm that is secured to the engine and directs the flow of air onto the compressor blades. These type of compressor diaphragms are typically broken into segments. The compressor diaphragms are typically broken into segments, but due to the thermal and aerodynamic loading on these segments, there is a tendency for the compressor diaphragm segments to move and/or rotate, causing wear to the compressor diaphragm segments and the case in which they are housed.

SUMMARY

In accordance with the present invention, there is provided a novel and improved system and method concerning an anti-rotation lug. Embodiments of the present invention concern a splitline jumper which is configured to remain captive in a compressor diaphragm assembly so as to provide a joining and anti-rotation function between adjacent compressor diaphragm segments.

In an embodiment of the present invention, a compressor diaphragm comprises a seal ring segment and a stator component coupled to the seal ring segment where a splitline jumper is positioned within the seal ring segment proximate a top face of the ring segment and extending towards an adjacent compressor diaphragm.

In an alternate embodiment of the present invention, a splitline jumper for connecting adjacent seal ring segments and preventing rotation of the seal ring segments is disclosed. The splitline jumper has a first portion with a first end and a second portion with a second end, where the second end is rounded.

In yet another embodiment of the present invention, a method of securing adjacent compressor diaphragms together comprises providing first and second compressor diaphragms where the diaphragms have a seal ring segment and a stator component. A splitline jumper is provided for joining the first and second diaphragms where a second portion of the splitline jumper is placed in the seal ring segment of the first or second diaphragm and a first portion of the splitline jumper is placed in the seal segment of an adjacent compressor diaphragm, such that the splitline jumper couples the first diaphragm to the second diaphragm to prevent the compressor diaphragms from rotation.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

The present invention is described in detail in relation to FIGS. 1-5 and can be applied to variety compressor diaphragm configurations utilizing anti-rotation features.

Figure 1:
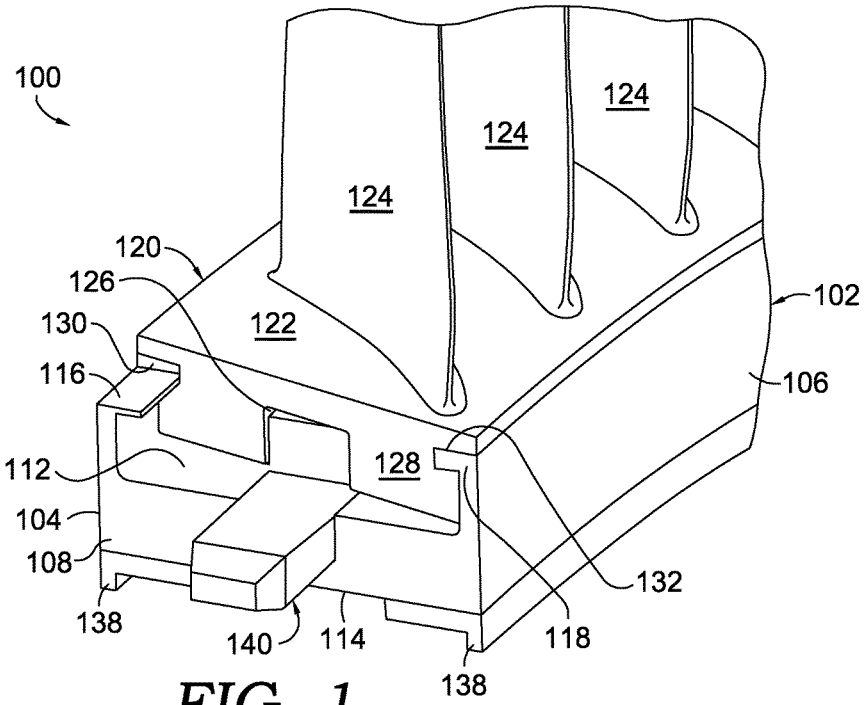
FIG. 1 is a perspective view of a portion of a compressor diaphragm in accordance with an embodiment of the present invention.
Figure 3:
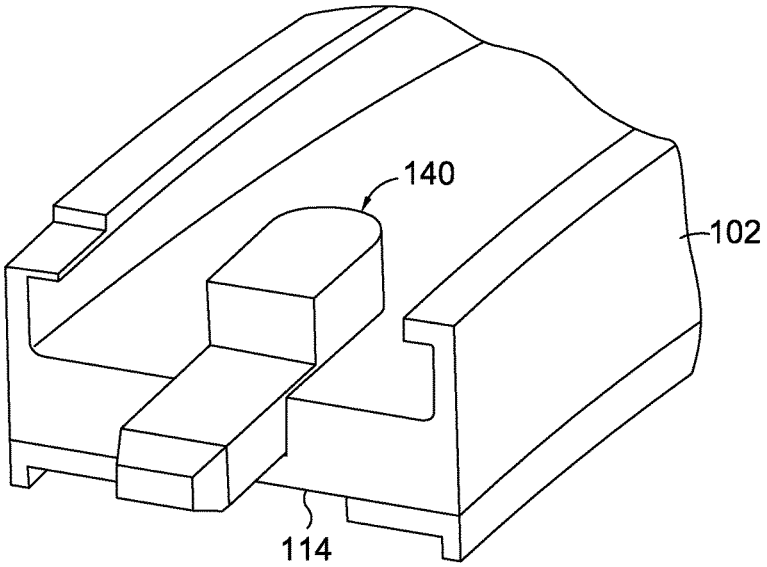
FIG. 3 is a perspective view of a portion of a compressor diaphragm and splitline jumper in accordance with an embodiment of the present invention.
Figure 4:
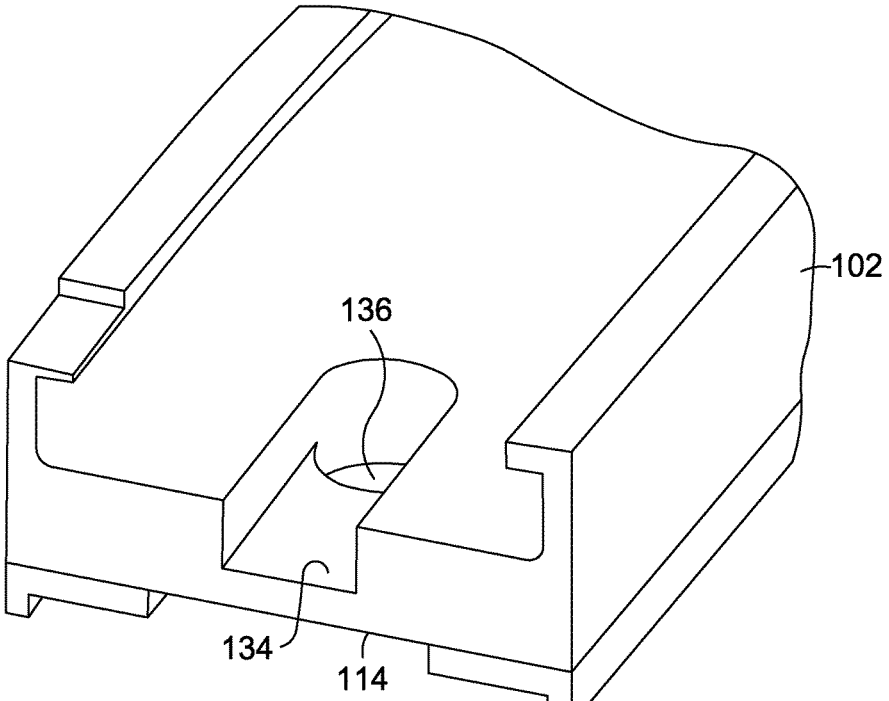
FIG. 4 is a perspective view of a portion of a seal ring segment of a compressor diaphragm in accordance with an embodiment of the present invention; and, FIG. 5 is a perspective view of a splitline jumper in accordance with an embodiment of the present invention.

Referring initially to FIG. 1 a portion of a compressor diaphragm 100 is depicted. As shown in FIGS. 1, 3, and 4, the compressor diaphragm 100 comprises a seal ring segment 102, where the seal ring segment 102 has a forward face 104, an aft face 106, a first side face 108 and a second, and opposing side face 110 (not depicted). The seal ring segment 102 also comprises a top face 112 and an opposing bottom face 114.

Figure 2:
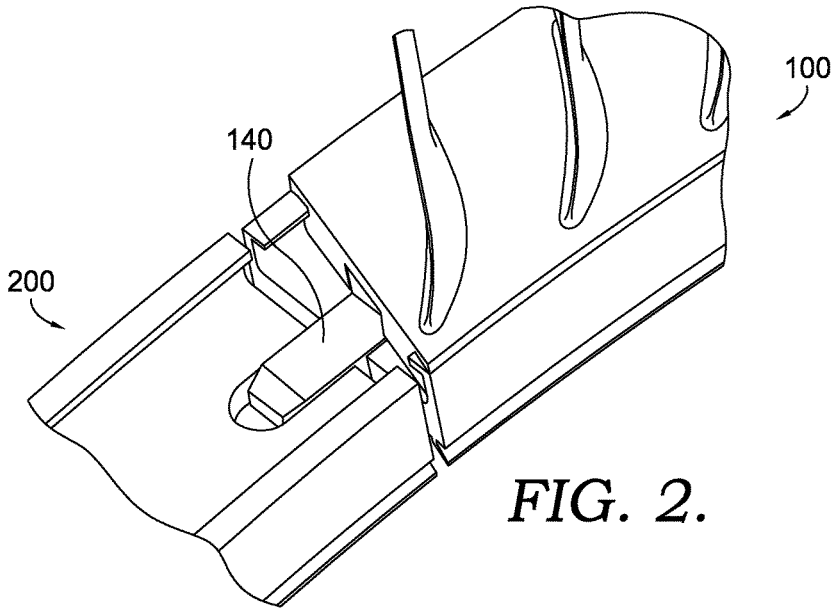
FIG. 2 is a perspective view of portions of adjacent compressor diaphragms in accordance with an embodiment of the present invention.

The compressor diaphragm 100 also comprises a stator component 120 coupled to the seal ring segment 102. The stator component 120, which is depicted in FIGS. 1 and 2, comprises a platform 122 and a plurality of airfoils 124 extending outward from the platform. The quantity of airfoils 124 comprising the stator component 120 can vary. For the embodiment depicted in FIGS. 1 and 2, three airfoils 124 are spaced along the stator component 120. In an embodiment of the present invention, the stator component 120 further comprises an opening 126 located along a side face 128 of the platform 122. The purpose of this opening 126 will be better understood in view of the discussion below.

Referring now to FIGS. 1 and 3, the compressor diaphragm 100 also comprises a splitline jumper 140 that is positioned within the seal ring segment 102, proximate the top face 112. The splitline jumper 140 extends from a side face of the ring segment, such as first side face 108 across a gap and towards an adjacent compressor diaphragm, as shown in FIG. 2.

Referring to FIGS. 1, 3, and 4, the seal ring segment 102 also includes a forward hook 116 and an aft hook 118. The forward hook 116 and aft hook 118 are utilized to help aid in securing the stator component to the seal ring segment 102. More specifically, the forward hook 116 engages a forward slot 130 while the aft hook 118 engages an aft slot 132.

Referring specifically to FIG. 4, another feature in an embodiment of the present invention of the seal ring segment 102 is a recessed portion 134. As will be discussed in more detail below, the recessed portion 134 provides a region in the seal ring segments 102 for receiving the splitline jumper 140. The recessed portion 134 may be located proximate the top face 112 of the seal ring segment 102 and in an embodiment of the present invention further comprises an opening 136 that extends through the bottom face 114 of the seal ring segment 102. The recessed portion 134 can take on a variety of shapes and sizes, depending on the size of the seal ring segment 102 and the size of the splitline jumper 140. One such geometry for the recessed portion 134 is a U-shape, as depicted in FIGS. 2 and 4.

Figure 5:
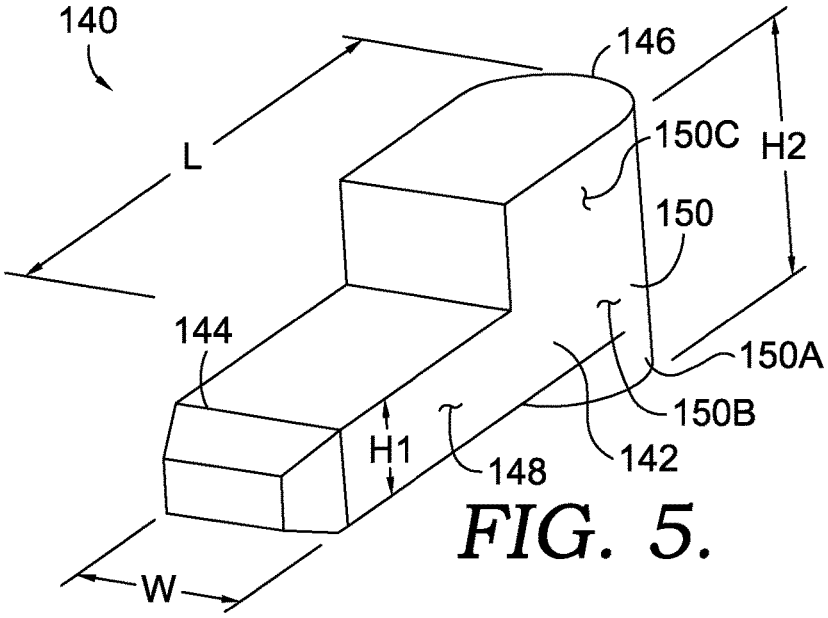

Referring now to FIG. 5, a splitline jumper 140 is shown in perspective view. As mentioned above, and will be discussed in more detail below, the splitline jumper 140 is used to bridge gaps between adjacent compressor diaphragms 100 and 200 in order to minimize the amount of relative axial movement between the adjacent compressor diaphragms and to prevent rotation between the compressor diaphragms and the seal rings. That is, in order to aid in manufacturing of the compressor diaphragms and stator components, it is desirable to split the full ring of the compressor components into segments. However, under aerodynamic and mechanical loading, these segments are susceptible to relative axial movement and rotation. Connecting the separated segments together in the engine helps to minimize the amount of relative movement.

The splitline jumper 140 comprises an elongated body 142 extending a length L and having a width W. The length L and width W can vary in size depending on the recessed portion 134. Width W is sized relative to a corresponding width in the recessed portion 134 so as to minimize movement of the splitline jumper 140 and therefore minimize movement of the compressor diaphragms.

The splitline jumper 140 extends from a first end 144 to an opposing second end 146. The splitline jumper 140 is essentially comprised of two portions, a first portion 148 and a second portion 150. The first portion 148 is generally rectangular and has a first height H1 while the second portion 150 has a second height H2. As it can be seen from FIG. 5, the second height H2 is greater than the first height H1. The first end 144 tapers from the first height H1 to a smaller height, while the second end 146 of the second portion may be rounded having a cylindrical profile. The second portion 150 of the splitline jumper 140 is further comprised of a lower portion 150A, a middle portion 150B, and an upper portion 150C. As it can be seen from FIG. 5, the lower portion 150A has a cylindrical cross section. However, the exact geometry of the splitline jumper may vary based on the geometry of the seal ring segment and compressor diaphragm.

A variety of manufacturing techniques can be used to fabricate the splitline jumper 140. For example, the splitline jumper could be cast in the desired shape, such as that shown in FIG. 5. Alternatively, the splitline jumper 140 could be machined from a piece of bar stock material or even welded or brazed together.

Referring to FIGS. 1-3, the present invention also discloses a way of securing adjacent compressor diaphragms together. As discussed above, compressor diaphragms are typically manufactured in a plurality of segments in order to aid the manufacturing process. These segments are then assembled into a semi-circular or 180 degree section segment. In order to secure adjacent diaphragms together, a first diaphragm 100 and a second diaphragm 200 are provided as discussed above, where each of the first and second diaphragms have a seal ring segment with a forward face, an aft face, first and second opposing side faces, a top face, and an opposing bottom face. The compressor diaphragm also comprises a stator component coupled to the seal ring segment, where the stator component comprises a platform and a plurality of airfoils extending out from the platform. The stator component of second diaphragm has been removed for clarity purposes.

A splitline jumper 140 is also provided for joining the first diaphragm 100 and the second diaphragm 200, where the splitline jumper 140 is in accordance with that shown in FIG. 5 and discussed above. The second portion of the splitline jumper 140 is placed with the recessed portion of a seal ring segment. More specifically, for the embodiment disclosed in FIG. 5 the cylindrical portion of the splitline jumper 140 engages the opening 136 in the recessed portion of the seal ring segment. The first portion of the splitline jumper 140 is then placed within the recessed portion of an adjacent compressor diaphragm such that the resultant assembly places the splitline jumper 140 in a position so as to couple the first compressor diaphragm 100 to the second compressor diaphragm and restrict the compressor diaphragms from rotating relative to each other. Due to the splitline jumper configuration and the recessed portion in the seal ring segment, the splitline jumper is secured within the seal ring segment in both an axially and tangential direction.

In an embodiment of the present invention, the splitline jumper 140 is separable from the recessed portion of the compressor diaphragm 100. In an alternate embodiment of the present invention, the splitline jumper 140 may be permanently or semi-permanently joined to the seal ring segment 102 or the stator component 120. Where the splitline jumper 140 is secured to the seal ring segment 102 or the stator component 120, the splitline jumper 140 may be added after other machining processes.

The present invention has been described in relation to particular embodiments, which are intended in all respects to be illustrative rather than restrictive. Alternative embodiments and required operations will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A compressor diaphragm comprising:

a seal ring segment having a forward face, an aft face, first and second opposing side faces, a top face and opposing bottom face;

a stator component coupled to the seal ring segment comprising a platform and a plurality of airfoils extending from the platform; and, a splitline jumper positioned within the seal ring segment proximate the top face and extending from a side face of the ring segment towards an adjacent compressor diaphragm;

wherein the seal ring segment further comprises a recessed portion sized to receive the splitline jumper; and wherein the recessed portion further comprises an opening extending through the bottom face of the seal ring segment.

2. The compressor diaphragm of claim 1, wherein the seal ring segment further comprises a forward hook and an aft hook.

3. The compressor diaphragm of claim 2, wherein the forward hook and the aft hook engage corresponding slots in the platform of the stator component.

4. The compressor diaphragm of claim 1, wherein the platform of the stator component further comprises an opening in a platform side face.

5. The compressor diaphragm of claim 1, wherein the recessed portion is generally U-shaped.

* * * * *